US005163348A

United States Patent [19]

Kitada et al.

[11] Patent Number: 5,163,348

[45] Date of Patent: Nov. 17, 1992

[54] METHOD OF AND APPARATUS FOR CUTTING FIBERS

[75] Inventors: Koshirou Kitada, Shiga; Tamemaru Esaki, Kyoto, both of Japan

[73] Assignees: Kuraray Co., Ltd., Kurashiki; Nishikawa Rose Co., Ltd., Kyoto, both of Japan

[21] Appl. No.: 826,393

[22] Filed: Jan. 27, 1992

[30] Foreign Application Priority Data

Jan. 28, 1991 [JP] Japan ..... 3-094655

[51] Int. Cl.[5] ..... D01G 1/04

[52] U.S. Cl. ..... 83/13; 83/37; 83/349; 83/409.1; 83/913

[58] Field of Search ..... 83/13, 37, 343, 349, 83/409, 409.1, 410.7, 410.8, 411.5, 913

[56] References Cited

U.S. PATENT DOCUMENTS 4,445,408 5/1984 Keith ..... 83/37

4,630,515 12/1986 Spaller ..... 83/402

*Primary Examiner*—Frank T. Yost

*Assistant Examiner*—Eugenia A. Jones

*Attorney, Agent, or Firm*—Oblon, Spivak, McClelland, Maier & Neustadt

[57] ABSTRACT

An apparatus for continuously cutting fibers to a predetermined length to provide staple fibers comprising at least one rotatably supported disc having a peripheral surface formed with a circumferential row of engagement projections radially outwardly protruding therefrom and spaced at intervals of a predetermined pitch and at least one cutting blade, the disc being rotatable sequentially past a delivery station and then past a cutting station during one complete rotation thereof. The fibers are at the delivery station delivered successively onto the disc so as to cause the fibers to be substantially traversed in a zig-zag fashion while extending alternately outwardly and inwardly around the engagement projections, and then partially pressed against such every other engagement projections by means of an endless belt drivingly trained around the disc. Portions of the fibers, which extend outwardly around every other engagement projections, are, when brought to a cutting station, successively cut by an impact shearing action created by the cutting blade in cooperation with the every other engagement projections around which those portions of the fibers extend outwardly, thereby providing the staple fibers.

8 Claims, 4 Drawing Sheets

METHOD OF AND APPARATUS FOR CUTTING FIBERS

BACKGROUND OF THE INVENTION

1. Field of the Invention

The present invention relates to a method of and an apparatus for continuously cutting fibers and, particularly, those known as super high-tenacity fibers, to a predetermined length.

2. Description of the Prior Art

Various methods of and/or apparatus suitable for cutting particular types of fibers have hitherto been suggested. As is well known to those skilled in the art, of inorganic fibers including steel fibers, glass fibers, ceramics fibers and carbon fibers, the glass fibers, the ceramics fibers and the carbon fibers have long been recognized as having both a relatively high tensile strength and a relatively high rigidity, but being relatively fragile. Because of those properties, the cutting of the glass fibers, the ceramics fibers or the carbon fibers is generally carried out by the use of a so-called roving cutter assembly operable to flaw the filaments or rovings by means of a plurality of metal blades. The roving cutter assembly is of a type comprising a rotatably supported cutter roller, on which the metal blades are spacedly mounted, and a counter roller cooperable with the rotary cutter roller so that, during the passage of the filaments or rovings through a nipping region defined between the cutter and counter rollers, the filaments or rovings can be cut to a predetermined or desired length.

On the other hand, when it comes to the cutting of organic synthetic fibers such as fibers of polyester, polyacryronitrile, polypropylene, polyethylene, polyvinylidene chloride, polyvinyl chloride, polyamide or polyvinyl alcohol resin, or chemical fibers such as Rayon or acetate, it is a general practice to cut these fibers by the use of a guillotine cutter after these fibers have been gathered together into a tow or a bundle of rovings or filaments, which tow or bundle has a thickness greater than some ten thousand deniers. The guillotine cutter referred to above is of a type comprising a pair of spaced apart guide rails, a stationary blade at one ends of the guide rails and a movable blade movable along the guide rails towards the stationary blade and is designed so as to cut the fibers by a scissor action.

A recent version of cutter is of a type manufactured and sold by Teijin Seiki Co., Ltd. of Japan under a tradename of "EC Cutter". This type of cutter comprises a plurality of blades arranged in a generally cylindrical configuration and is so designed that the fibers can be cut into staple fibers as the fibers are firmly wrapped around the cylinder of the blades, which staple fibers are in turn drawn inside the cylinder of the blades through a space between each neighboring blades for the discharge thereof to a collecting box or a next succeeding work station.

However, recently developed reinforcement fibers suited as a reinforcement material to be used in a composite material such as fiber reinforced plastics (FRP) or fiber reinforced thermoplastics (FRTP), which are generally referred to advanced composites material (ACM), are required to have a tensile strength not lower than 100 kg/mm$^2$ and a modulus of elasticity not lower than 3,000 kg/mm$^2$ but have a small thickness (fiber diameter) within the range of 5 to 50 $\mu$m.

These ACM fibers are, after having been cut to a desired or required length, mixed into the composite material as reinforcement fibers. While the glass fibers are a representative of the various types of fibers which are mixed into the fiber reinforced plastics, the glass fibers are extremely fragile and often constitute a source of an environment pollution. Because of this, a recent trend is to use, in place of the glass fibers, commercially available super high-tenacity fibers such as fibers of polyvinyl alcohol sold under a tradename "TAFTEC" (manufactured and sold by Kuraray Co., Ltd. of Japan), fibers of all aromatic polyamido sold under a tradename "Kevlar" (manufactured and sold by E.I. Du Pont de Nemours and Company) or "TECHNORA" (manufactured and sold by Teijin Limited of Japan), fibers of all aromatic polyester sold under a tradename "VECTORAN" (manufactured and sold by Kuraray Co., Ltd. of Japan), or fibers of polyethylene sold under a tradename "Dyneema" (manufactured and sold by Toyobo Co., Ltd. of Japan). However, it has been found that, since these super high-tenacity fibers are extremely slender, flexible and rigid, the conventional cutting method can hardly be employed to cut these super high-tenacity fibers continuously at a high speed.

More specifically, when an attempt is made to cut the super high-tenacity fibers continuously by the use of the conventional roving cutter, the cutting blade is susceptible to a reduction in sharpness to such an extent that the satisfactory cutting cannot be attained even though the force necessary to cut is increased and, in the extreme case it may happen, the cutting will no longer be accomplished. On the other hand, if the use of the conventional guillotine cutter, which is generally considered effective for cutting a fiber tow of a thickness greater than some ten thousands deniers, is used to cut the super high-tenacity fiber continuously, not only is the cutting blade readily susceptible to a reduction in sharpness, but the blade edge thereof tends to be spoiled and/or a zone of heat fusion occurs at a cutting region, failing to properly cut the super high-tenacity fiber.

The conventional guillotine cutter is based on the principle that the cutting blade should have a sharp blade edge to cut a material to be cut. Accordingly, when it comes to the cutting of the super high-tenacity fiber of such a property as hereinbefore described with the use of the guillotine cutter, it appears that a satisfactory cutting cannot be accomplished, resulting an improper cutting of the fiber. In the case where the super high-tenacity fiber is to be cut with the use of the EC cutter which has a cutting mechanism substantially similar to that exhibited by the guillotine cutter, the super high-tenacity fiber tends to be tightened as a result of an increase of the fiber turning force in proportion to the reduction in sharpness of the cutting blade and, therefore, the cutting blade is susceptible to a breakage, failing to accomplish a smooth and proper cutting.

SUMMARY OF THE INVENTION

Accordingly, the present invention has aimed at solving the above discussed problems without relying on the sharpness of the blade edge such as observable in the guillotine cutter and by utilizing an impact shearing force which is produced when portions of the super high-tenacity fiber impinge successively upon a cutting bite during the transport of the super high-tenacity fiber in one direction.

Specifically, according to one aspect of the present invention, the present invention provides a method of continuously cutting fibers to a predetermined length to provide staple fibers with the use of a rotary cutting apparatus comprising at least one rotatably supported disc having a peripheral surface formed with a circumferential row of engagement projections radially outwardly protruding therefrom and spaced at intervals of a predetermined pitch and at least one cutting blade, said disc being rotatable sequentially past a delivery station and then past a cutting station during one complete rotation thereof, said cutting blade being disposed so as to cooperate with every other engagement projections on the disc to cut the fibers.

The cutting method according to the present invention comprises the steps of delivering at the delivery station the fibers onto the disc, while the latter is driven in one direction, so as to cause the fibers to be substantially traversed in a zig-zag fashion while extending alternately outwardly and inwardly around the engagement projections. During a continued feed of the fibers with the disc driven in said one direction, causing portions of the fibers, which extend inwardly around every other engagement projections, to be pressed against such every other engagement projections by means of an endless belt drivingly trained around the disc and, at the same time, portions of the fibers, which extend outwardly around every other engagement projections, are successively transported towards the cutting station. Thereafter, those portions of the fibers extending outwardly around every other engagement projections are successively cut by an impact shearing action created by the cutting blade in cooperation with said every other engagement projections around which said portions of the fibers extend outwardly, thereby providing the staple fibers.

The above described cutting method of the present invention makes use of the impact shearing action created by the cutting blade in cooperation with the every other engagement projections around which those portions of the fibers extend outwardly, thereby providing the staple fibers of the predetermined length.

Also, according to another aspect of the present invention, the present invention provides an apparatus for continuously cutting fibers to a predetermined length to provide staple fibers comprising at least one rotatably supported disc having a peripheral surface formed with a circumferential row of engagement projections radially outwardly protruding therefrom and spaced at intervals of a predetermined pitch and at least one cutting blade, the disc being rotatable sequentially past a delivery station and then past a cutting station during one complete rotation thereof. The fibers are at the delivery station delivered successively onto the disc so as to cause the fibers to be substantially traversed in a zig-zag fashion while extending alternately outwardly and inwardly around the engagement projections, and then partially pressed against such every other engagement projections by means of a pressing means. Portions of the fibers, which extend outwardly around every other engagement projections, are, when brought to a cutting station, successively cut by an impact shearing action created by the cutting blade in cooperation with the every other engagement projections around which those portions of the fibers extend outwardly, thereby providing the staple fibers.

Preferably, the pressing means may comprise an endless belt trained around the rotary disc assembly and driven in unison with the rotation of the rotary disc assembly. This endless belt preferably has a generally V-shaped cross-section, having a pair of side faces extending so as to diverge in a direction radially outwardly of the rotary disc assembly, said side faces of the endless belt being cooperable with the inner side faces of the remaining engagement projections to clamp the fibers therebetween, each of said inner side faces being inclined to follow an inclination of the adjacent side face of the endless belt. The use of the endless belt for the pressing means makes it possible to render the cutting apparatus to be compact in structure.

Preferably, each of the engagement projections has inner and outer side faces facing in a direction parallel to an axis of rotation of the rotary disc assembly, each of the respective side faces of engagement projections being in flush with one of opposite side surfaces of the rotary disc assembly. With this flush-in structure, the surface shaving of the rotary disc having the engagement projections can be facilitated.

While the foregoing cutting apparatus can satisfactory work and is designed to cut at least one fiber, an alternative embodiment of the present invention provides the rotary cutting apparatus of the type referred to above, wherein the rotary disc assembly comprises a pair of rotary discs and an intermediate coupling barrel connecting the rotary disc coaxially together. In this apparatus, the circumferential row of the engagement projections is formed on an outer peripheral surface of each of the rotary discs, and the cutting blade is disposed on respective sides of the rotary discs remote from the intermediate coupling barrel so as to cooperate with every other engagement projections in the corresponding circumferential row.

With the rotary cutting apparatus according to the alternative embodiment of the present invention, the two fibers can be simultaneously cut and, accordingly, the cutting efficiency may be twice that exhibited by the apparatus designed to cut the single fiber.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined solely by the appended claims. In the accompanying drawings, like reference numerals are used to denote like parts throughout the several views, and:

DETAILED DESCRIPTION OF THE EMBODIMENTS

Figure 1:
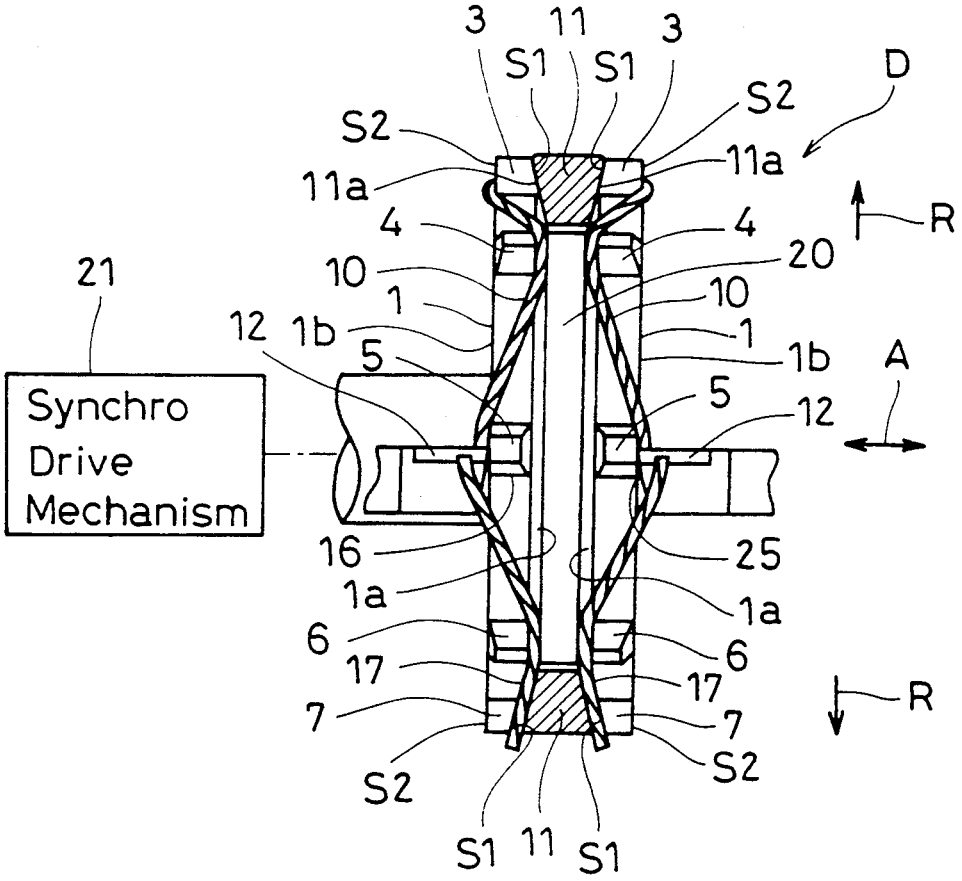
FIG. 1 is front sectional view of a cutting apparatus according to the present invention, showing only a rotary disc assembly employed therein.
Figure 2:
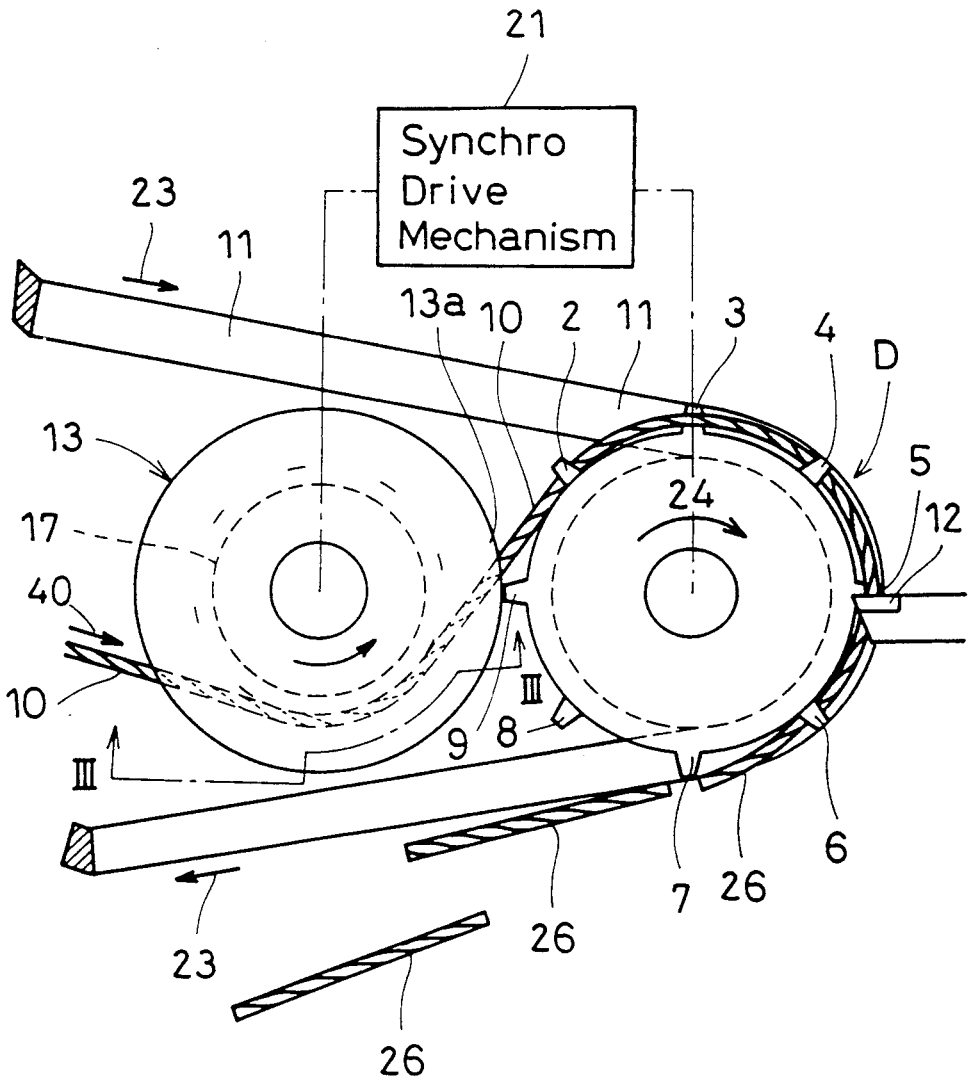
FIG. 2 is a side sectional view, on a reduced scale, of the cutting apparatus shown in FIG. 1.
Figure 3:
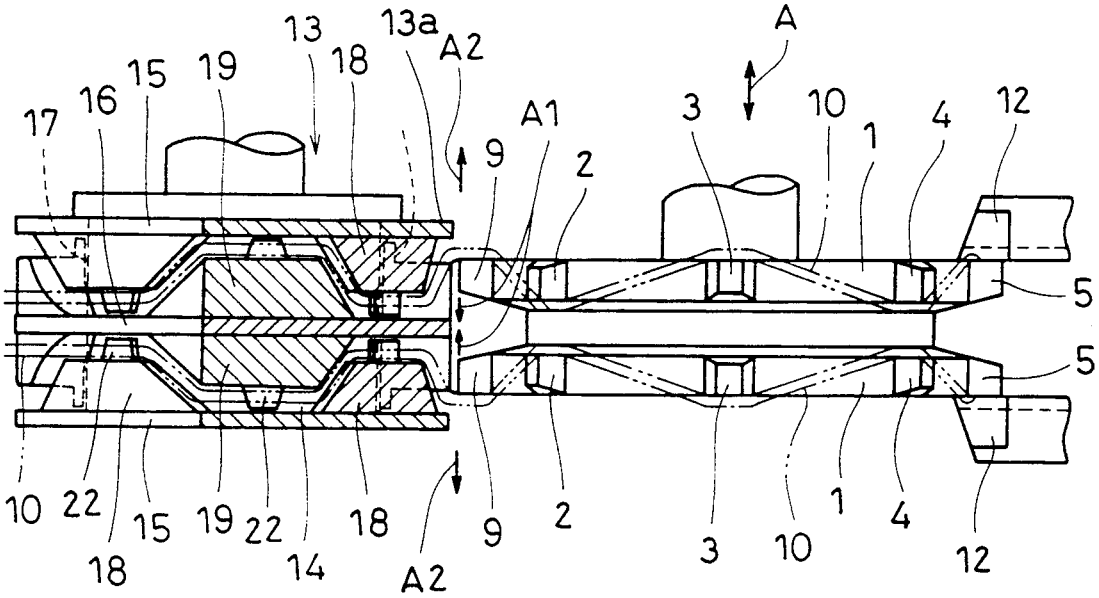
FIG. 3 is a cross-sectional view taken along the line III—III in FIG. 2 showing the cutting apparatus with an endless belt removed.

Referring first to FIGS. 1 to 3 showing a first preferred embodiment of the present invention, a fiber cutting apparatus comprises a rotary disc assembly generally identified by D. The rotary disc assembly D includes a pair of left-hand and right-hand rotary discs 1 of a structure substantially similar to each other and having a substantial thickness. Each of the left-hand and right-hand rotary discs 1 has inner and outer side surfaces 1*a* and 1*b* opposite to each other with respect to a direction A parallel to the axis of rotation of the rotary disc assembly D, and these left-hand and right-hand rotary discs 1 are rigidly connected together by means of an intermediate coupling barrel 20 in a side-by-side fashion with the respective inner side surfaces 1*a* of the left-hand and right-hand rotary discs 1 confronting with each other.

Each of the left-hand and right-hand rotary discs 1 has its outer peripheral surface formed with a plurality of, for example, eight, engagement projections 2, 3, 4, 5, 6, 7, 8 and 9 protruding radially outwardly therefrom and spaced at intervals of a predetermined pitch, for example, at an equal distance in a direction circumferentially of the respective rotary disc 1 in a pattern substantially similar to gear teeth, each of said engagement projections 2 to 9 being adapted for engagement with a super high-tenacity fiber 10 to be cut to a desired or predetermined length as will become clear from the subsequent description. With the left-hand and right-hand rotary discs 1 connected together as described above, the engagement projections 2 to 9 on the left-hand rotary disc 1 are paired with the engagement projections 2 to 9 on the right-hand rotary disc 1, respectively.

As best shown in FIG. 1, each of the engagement projections 2 to 9 is of a shape generally similar to the shape of a truncated pyramid and having inner and outer side faces S1 and S2 opposite to each other with respect to the direction A parallel to the axis of rotation of the rotary disc assembly D. Preferably, these engagement projections 2 to 9 are so formed integrally with the outer peripheral surface of each rotary disc 1 that the inner and outer side faces S1 and S2 of every other engagement projections can be continued in flush with and inclined inwardly relative to the side surfaces 1*a* and 1*b* of the corresponding rotary disc 1, respectively. By way of example, so far illustrated, each of the even-numbered engagement projections 2, 4, 6 and 8 has its inner side face S1 continued to the side face 1*a* of the respective rotary disc 1 so as to be in flush with such inner side face 1*a* while each of the odd-numbered engagement projections 3, 5, 7 and 9 has its outer side face S2 contiguous to the side face 1*b* of the respective rotary disc 1 so as to be in flush with such outer side face 1*b*.

Although the formation of the outer side faces S2 of the odd-numbered engagement projections 3, 5, 7 and 9, in a fashion continued in flush with the outer side surface 1*b* of the corresponding rotary disc 1 and of the inner side faces S1 of the even-numbered engagement projections 2, 4, 6 and 8 in a fashion continued in flush with the inner side surface 1*a* of the corresponding rotary disc 1 makes it possible to facilitate a surface shaving job, the outer side faces S2 of the odd-numbered engagement projections 3, 5, 7 and 9 and the inner side faces S1 of the even-numbered engagement projections 2, 4, 6 and 8 may not be always in flush with the outer and inner side surface 1*b* and 1*a* of the corresponding rotary disc 1, respectively. In the practice of the present invention, the shape of each of the engagement projections 2 to 9 on each of the left-hand and right-hand rotary discs 1 may not be always limited to the specific shape shown and described above.

A generally V-shaped space delimited radially outwardly of the intermediate coupling barrel 20 and between the paired engagement projections 2 to 9 on the respective left-hand and right-hand rotary discs 1 connected together through the intermediate coupling barrel 20 is used to accommodate a generally V-sectioned endless belt 11 which is trained between the rotary disc assembly D and a drive pulley (not shown) coupled drivingly with a drive mechanism as best shown in FIG. 2. So far illustrated, the V-sectioned feature of the endless belt 11 is delimited by a pair of side faces 11*a* that extend so as to depict a shape generally similar to the shape of a figure "V" diverging in a direction R radially outwardly of the rotary disc assembly D. As will become clear from the subsequent description, this V-sectioned endless belt 11 serves as an urging means for urging the super high-tenacity fibers 10 so as to contact the inclined inner side faces S1 of the even-numbered engagement projections 2, 4, 6 and 8.

With the V-sectioned endless belt 11 so trained around the rotary disc assembly D, the inner side faces S1 of the odd-numbered paired engagement projections 3, 5, 7 and 9 formed on the respective rotary discs 1 are so inclined inwardly of the rotary disc assembly D as to follow the generally V-sectioned feature delimited by the side faces 11*a* of the endless belt 11.

As best shown in FIGS. 1 and 2, the rotary cutting apparatus embodying the present invention also comprises a pair of stationary cutting blades 12 in association with the respective left-hand and right-hand rotary discs 1, and a rotary traversing device 13. Each of the cutting blades 12 may be of a type similar to a cutting bite generally employed in a machine tool such as a lathe and is disposed in the vicinity of one of opposite outer peripheral side edges of the respective rotary disc 1 remote from the V-sectioned endless belt 11 so as to be cooperable with the outer side faces S2 of the odd-numbered engagement projections 3, 5, 7 and 9 to create an impact shearing action or substantially scissor action as will be described latter.

The rotary traversing device 13 forming a substantial part of a fiber turning means is positioned on one side of the rotary disc assembly D generally opposite to the stationary cutting blades 12 in a juxtaposed fashion therewith and within a space delimited between upper and lower runs of the V-sectioned endless belt 11. This rotary traversing device 13 is drivingly coupled with the rotary disc assembly D by means of a synchro drive mechanism 21 so that the rotary disc assembly D and the rotary traversing device 13 can be rotated in unison in respective directions counter to each other as indicated by the arrows.

The rotary traversing device referred to above is conventionally embodied in numerous types and, therefore, the rotary traversing device which may be employed in the practice of the present invention may not be limited to a particular type. However, the use is preferred of the rotary traversing device 13 of a type having, as shown in a fragmentary sectional representation in FIG. 3, a pair of patterned guide grooves 14 because it is best suited for use in a high speed fiber turning operation.

More specifically, referring to FIGS. 2 and 3, the preferred form of rotary traversing device 13 comprises an inner drum 17 having opposite ends to which left-hand and right-hand round side plates 15 are secured. The inner drum 17 has an annular intermediate plate 16 formed on an outer peripheral surface of the inner drum 17 so as to protrude radially outwardly therefrom and positioned intermediate between the left-hand and right-hand round side plates 15. Respective peripheral portions of the left-hand and right-hand round side plates 15 are integrally formed, or otherwise rigidly secured, with respective pluralities of guide projections 18 which protrude towards the annular intermediate plate 16. On the other hand, the annular intermediate plate 16 has its opposite annular surfaces integrally formed, or otherwise rigidly secured, with respective corresponding numbers of guide projections 19 which protrude towards the respective round side plates 15.

As best shown in FIG. 3, the guide projections 18 and 19 are so shaped and so positioned that left-hand and right-hand patterned guide grooves 14 can be formed between the annular intermediate plate 16 and the respective round side plates 15, each patterned guide groove extending in a zig-zag fashion over the circumference of the rotary traversing device 13. The guide grooves 14 are used to accommodate therein the respective super high-tenacity fibers 10 during the rotation of the rotary traversing device 13 in one direction so that the super high-tenacity fibers 10 can be smoothly transferred onto the rotary disc assembly D in a manner as will be described latter. The guide projections 18 and 19 rigid or fast with the round side plates 15 and the annular intermediate plate 16 are formed with support nails 22 positioned radially inwardly thereof so as to support the associated super high-tenacity fibers 10 from below in a direction radially outwardly of the inner drum 17.

The guide projections 18 or 19 are spaced circumferentially of the inner drum 17 a pitch determined in consideration of the pitch between each neighboring engagement projections 2 to 9 on the adjacent rotary disc 1 of the rotary disc assembly D. Preferably the pitch between each neighboring guide projections 18 or 19 is chosen to be twice the pitch between each neighboring engagement projections 2 to 9 on the adjacent rotary disc 1.

In any event, these guide grooves 14 defined between the annular intermediate plate 16 and the round side plates 15 are so shaped and so arranged that, each time the paired guide projections 18 on the rotary traversing device 13 are, during the rotation of the rotary traversing device 13, brought to a delivery position 13*a* at the front portion of the rotary traversing device 13 in readiness for the delivery of the super high-tenacity fibers 10 onto the rotary disc assembly D, respective portions of the super high-tenacity fibers 10 can be guided so as to converge close towards each other in an axially inward direction, shown by the arrows A1 and that, each time the paired guide projections 19 are subsequently brought to the delivery position 13*a* in readiness for the successive delivery of the super high-tenacity fibers 10 onto the rotary disc assembly D, respective portions of the super high-tenacity fibers 10 can be guided so as to expand away from each other in an axially outward direction, shown by the arrows A2. Thus, it will readily be understood that, at the delivery position 13*a*, the super high-tenacity fibers 10 can be reciprocally and alternately shifted in the direction A parallel to the axis of rotation of the rotary disc assembly D at a cycle corresponding to the pitch between each neighboring engagement projections 2 to 9 on the rotary disc assembly D so that they can be laid on the rotary disc assembly D while being substantially traversed in a zig-zag fashion as clearly shown by the phantom line in FIG. 3, turning inwardly around the even-numbered engagement projections 2, 4, 6 and 8 and outwardly around the odd-numbered engagement projections 3, 5, 7 and 9.

The cutting apparatus constructed as hereinbefore described according to the present invention operates in the following manner.

Assuming that the super high-tenacity fibers 10 drawn out from suitable bobbins (not shown) in a transport direction shown by the arrow 40 in FIG. 2 are turned from below around the rotary traversing device 13 and then turned from above around the rotary disc assembly D as shown in FIG. 2, those respective portions of the super high-tenacity fibers 10 brought to the delivery position 13*a* during the synchronized rotation of the rotary traversing device 13 and the rotary disc assembly D are delivered onto the rotary disc assembly D in a zig-zag fashion as shown by the phantom line in FIG. 3, turning inwardly around the even-numbered engagement projections 2, 4, 6 and 8 in contact with the inner side faces S1 thereof and outwardly around the odd-numbered engagement projections 3, 5, 7 and 9 in contact with the outer side faces S2 thereof. During the continued rotation of the rotary disc assembly D having the super high-tenacity fibers 10 partly turned therearound, successive portions of the super high-tenacity fibers 10 held in contact with the inner side faces S1 of the even-numbered engagement projections 2, 4, 6 and 8 are subsequently urged by the V-sectioned endless belt 11, then driven by a drive mechanism (not shown) in a direction shown by the arrow 23 in FIG. 2, to firmly contact the inner side faces S1 of such even-numbered engagement projections 2, 4, 6 and 8, accompanied by the rotation of the rotary disc assembly D in the direction shown by the arrow 24. It is to be noted that the V-sectioned endless belt 11 drives the rotary disc assembly D in synchronism therewith so that the super high-tenacity fibers 10 having their successive portions clamped between the side faces 11*a* of the V-sectioned endless belt 11 and the inner side faces S1 of the even-numbered engagement projections 2, 4, 6 and 8 can be transported in a direction conforming to the direction 24 of rotation of the rotary disc assembly D.

As those portions of the super high-tenacity fibers 10 turned in the zig-zag fashion around the rotary disc assembly D, which are turned outwardly of and in contact with the outer side faces S2 of the odd-numbered engagement projections 3, 5, 7 and 9, are successively brought to a cutting station where the stationary cutting blades 12 are installed, they receive an impact shearing action created between the stationary cutting blades 12 and leading edges of the outer side faces S2 of the odd-numbered engagement projections 3, 5, 7 and 9 with respect to the direction of rotation of the rotary disc assembly D. By this impact shearing action similar to the scissor action, the super high-tenacity fibers 10 are cut to a length corresponding to each neighboring odd-numbered engagement projections 3, 5, 7 and 9, that is, twice the pitch between each neighboring engagement projections 2 to 9.

As can be understood from FIG. 2, when the super high tenacity fibers 10 are so cut by the impact shearing action, different portions of the super high-tenacity fibers 10 situated on the leading side and the trailing side of those portions of the same super high-tenacity fibers 10 which are being cut with respect to the direction 24 of rotation of the rotary disc assembly D are firmly clamped between the inner side faces S1 of the respective even-numbered engagement projections 4 and 6 and the associated side faces 11*a* of the V-sectioned endless belt 11 and, therefore, respective portions of the super high-tenacity fibers 10 extending between the neighboring engagement projections 4 and 6 are held under such a proper tension as to facilitate the cutting. Even after the cutting, respective lengths of the super high-tenacity fibers 10 which have been cut are retained between the side faces 11*a* of of the V-sectioned endless belt 11 and the even-numbered engagement projection 6, which have been moved past the cutting station, before such some of the even-numbered engagement projections depart from the V sectioned endless belt 11. The super high-tenacity fibers 10 having been cut to the predetermined length can fall downwards by gravity onto a collection box or a belt conveyor (both not shown) only after a disengagement has taken place between the even-numbered engagement projection 8 and the side faces 11*a* of the V-sectioned endless belt 11.

Thereafter, the next succeeding portions of the super high tenacity fibers 10 are transported towards the cutting station while retained in the manner as described above and are then cut to the predetermined length when the next succeeding odd-numbered engagement projections 3, 5, 7 or 9 are brought to the cutting station during the continued rotation of the rotary disc assembly D. In this way, the super high tenacity fibers 10 can be automatically and successively cut by the stationary cutting blades 12 to provide staple fibers 26 of the predetermined length substantially equal to twice the pitch between each neighboring engagement projections 2 to 9.

As the foregoing description has made it clear, the pitch between each neighboring engagement projections 2 to 9 is determinative of the length to which the super high-tenacity fibers 10 are cut and may, accordingly, be chosen as desired by the employment of an increased or reduced number of the paired engagement projections 2 to 9. The diameter of the rotary disc 1 or the pitch of the engagement projections 2 to 9 actually employed on the rotary disc assembly D is preferably so chosen that the staple super high-tenacity fibers 26 may have a length within the range of 15 to 150 mm and, more preferably within the range of 20 to 150 mm. Also, if the staple super high-tenacity fibers 26 of a varying length are desired, each neighboring engagement projections 2 to 9 may have a varying pitch therebetween. Each of the engagement projections 2 to 9 should have a height, as measured radially outwardly from the outer peripheral surface of each rotary disc 1, which may be determined in consideration of the thickness of the fibers desired to be cut so that the size of a gap between each side face 11*a* of the V-sectioned endless belt 11 and the inner side face S1 of each of the even-numbered engagement projections 2, 4, 6 and 8 can be adjusted to adjust a pressing force acting on each fiber for the purpose of enabling each portion of the fibers between the each neighboring even-numbered engagement projections 2, 4, 6 and 8 to be held constantly under a proper tension.

According to the present invention, in order for the impact shearing force to be uniformly imparted to the super high-tenacity fibers 10 during the cutting, the thickness of the super high-tenacity fibers (or the total thickness in the case of a multifilament) is preferably within the range of 50 to 10,000 deniers and, more preferably within the range of 500 to 5,000 deniers. The cutting speed may vary depending on the type and/or the thickness of the super high-tenacity fibers to be cut, however, the use of a high cutting speed is preferred. By way of example, with the cutting apparatus of the present invention, the cutting is possible with a feed speed of the super high-tenacity fibers within the range of 50 to 5,000 meters per minute.

It is to be noted that the fiber referred to hereinbefore and hereinafter as being cut by the use of the rotary cutting apparatus of the present invention is to be understood as meaning a plurality of fibers in a bundled configuration as it is a general practice in the art. However, in the practice of the present invention, the fiber to be cut may be a single fiber as the term stands.

Figure 4:
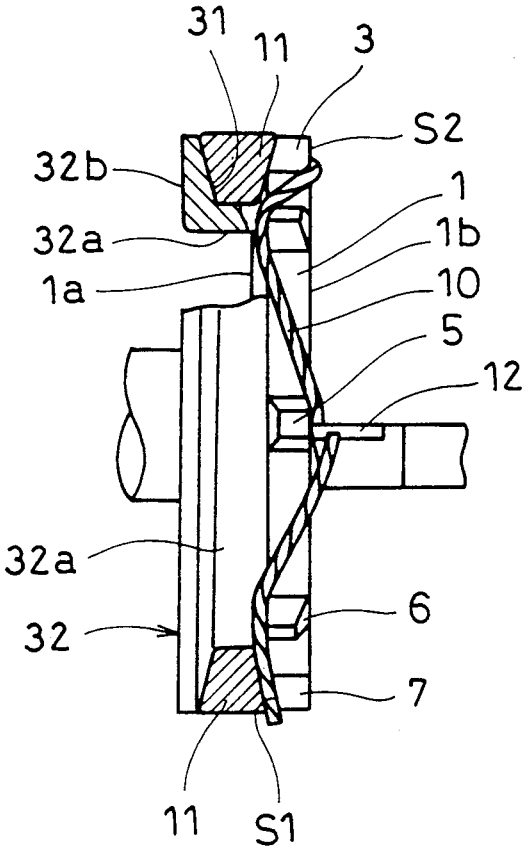
FIG. 4 is a view similar to FIG. 1, showing the cutting apparatus according to another preferred embodiment of the present invention.

It is also to be noted that, in the foregoing description of the preferred embodiment of the present invention made with reference to FIGS. 1 to 3, the rotary cutting apparatus may be referred to a double rotary cutting apparatus as it is designed to cut the two lengths of super high-tenacity fibers 10 at the same time. Specifically, in the double rotary cutting apparatus, the use has been made of the two rotary discs 1 with the corresponding rows of the engagement projections 2 to 9 formed thereon and the two cutting blades 12, both disposed in a symmetrical relation on respective side of the V-sectioned endless belt 11. Correspondingly, the rotary traversing device 13 is of a symmetrical construction with respect to the plane of the annular intermediate plate 16, having the two zig-zag guide grooves 14 defined therein. The double rotary cutting apparatus is indeed high in fiber handling capacity and high in cutting efficiency. However, the double rotary cutting apparatus is not required in cutting a single length of super high-tenacity fiber.

Where the rotary cutting apparatus designed specifically to cut a single length of super high-tenacity fiber is desired, the rotary traversing device maalsoy be of a structure similar to one of the halves of the rotaralsoy traversing device 13 shown in FIG. 3 divided along plane of the annular intermediate plate 16 and, on the other hand, the rotary disc assembly may be modified to comprise, as shown in FIG. 4, a single disc 1 having a substantial thickness and having a single row of the engagement projections 2 to 9 formed on the outer peripheral surface thereof and spaced at intervals of the predetermined pitch in the circumferential direction. The rotary disc assembly according to the alternative embodiment of FIG. 4 also comprises a generally L-sectioned belt support wheel 32 including a circumferential base 32*a* and a radially outwardly extending annular flange 32*b*, said support wheel 32 being formed integrally with or rigidly connected to the single disc 1 with the circumferential base 32*a* secured to an outer peripheral portion of the single disc 1. It will readily be seen that, in this alternative embodiment, respective portions of the single super high-tenacity fiber 10 which are turned around the even-numbered engagement projections 2, 4, 6 and 8 in contact with the inner side faces S1 thereof can be successively clamped between one side face 11*a* of the V-sectioned endless belt 11 and the respective inner side faces S1 of the even-numbered engagement projections 2, 4, 6 and 8, during the rotation of the single rotary disc assembly.

Hereinafter, the rotary cutting apparatus according to the present invention will be demonstrated by way of examples which are not intended to limit the scope of the present invention, but are taken only for the purpose of illustration.

EXAMPLE A

In the rotary cutting apparatus shown in and described with reference to FIGS. 1 to 3, each of the rotary discs 1, 70 mm in outer diameter, was made of a machine tool steel and was formed on its outer peripheral surface with the circumferential row of the eight engagement projections 2 to 9 spaced circumferentially at intervals of an equal pitch, each engagement projection being 4 mm in width (as measured in a direction parallel to the axis of rotation of the rotary disc assembly) and 5 mm in height. Each of the cutting blades 12 used was in the form of a commercially available throw-away chip (manufactured and sold by Mitsubishi Materials Corporation of Japan under a tradename "STi20". The two lengths of the super high-tenacity fibers 10 employed were those of "VECTRAN" (Fiber Diameter: 20 μm, Tensile Strength: 368 kg/mm$^2$, young's Modulus: 8,500 kg/mm$^2$, 300 filaments: 1,500 deniers).

While the two lengths of the super high-tenacity fibers 10 were continuously delivered onto the rotaralsoy disc assembly D with the super high-tenacity fibers 10 extending in the zig-zag fashion around the engagement projections 2 to 9 in the manner as hereinbefore described, and the rotary disc assembly D was driven at a peripheral speed of 100 meters per minute, the two lengths of the super high-tenacity fibers 10 could satisfactorily be cut continuously into staple super high-tenacity fibers of 50 mm in length with no failure to cut. The rotary cutting apparatus was run continuouslalsoy for 5 hours with no cutting failure having occurred.

EXAMPLE B

Using the same rotary cutting apparatus as used in Example A above, the two lengths of the super high-tenacity fibers 10 in the form of those of high-tenacity "Vinylon 7901" (Fiber Diameter: 14 μm, Tensile Strength: 230 kg/mm$^2$, young's Modulus: 6,100 kg/mm$^2$, 1,000 filaments: 1,800 deniers) were cut in the following manner.

While the two lengths of the super high-tenacity fibers 10 were continuously delivered onto the rotary disc assembly D with the super high-tenacitalsoy fibers 10 extending in the zig-zag fashion around the engagement projections 2 to 9 in the manner as hereinbefore described, and the rotary disc assembly D was driven at a peripheral speed of 150 meters per minute, the two lengths of the super high-tenacity fibers 10 could satisfactorilalsoy be cut continualsoously into staple super high-tenacity fibers of 50 mm in length with no failure to cut. Even when the rotary cutting apparatus was run continuously for 10 hours, no cutting failure occurred and no abnormalitalsoy was found in the rotary cutting apparatus.

Some preferred examples of use of the rotary fiber cutting apparatus according to the present invention includes a manufacture of fiber reinforced synthetic resin moldings and that of fiber reinforced concrete moldings. In the practice of the method of manufacturing the fiber reinforced synthetic resin moldings or the fiber reinforced concrete moldings, the rotary fiber cutting apparatus embodying the present invention may be installed at the site of preparation of a mixture of fibers with a synthetic resin material or a mixture of fibers with concrete so that a mixing of staple fibers, obtained in situ with the cutting of the organic fibers, with the synthetic resin material or the concrete can be carried out to provide the fiber reinforced synthetic resin moldings or the fiber reinforced concrete moldings.

By the use of the method referred to above, the fiber reinforced resin synthetic moldings or the fiber reinforced concrete moldings having uniform physical properties can be manufactured efficiently and effectively. This is not possible with the prior art organic fiber cutting apparatuses because the prior art organic fiber cutting apparatuses are generally bulky in size and cannot therefore be installed at the site of manufacture of the fiber reinforced synthetic resin or concrete moldings.

Specifically, the prior art generally requires a relatively large-sized cutting apparatus to be installed at a plant where the fibers are produced, and the fibers produced at the plant are packed into an evacuated package so that the evacuated package containing the fibers can be transported to the site of work where the fiber after having been unwrapped are mixed into a viscous compound of synthetic resin or concrete material. The evacuated package of the fibers often poses a problem in that, when the evacuated package is unwrapped at the site of work, the fibers are so intermingled with each other forming lumps of fibers which are generally difficult to release. Should these lumps of fibers be mixed into the viscous compound of synthetic resin or concrete material, it is not possible to provide the fiber reinforced synthetic resin moldings or fiber reinforced concrete moldings in which the fibers are uniformly dispersed.

On the other hand, the rotary fiber cutting apparatus of the present invention is so compact in size as to permit it to be installed at the site of work and, therefore, the staple fibers as cut with the rotary cutting apparatus can be mixed in situ into the viscous compound of synthetic resin or concrete material for the production of the fiber reinforced synthetic resin or concrete moldings. Therefore, the present invention is substantially free from such a problem that the fibers to be mixed with the synthetic resin or the concrete material form lumps, and therefore, the fibers cut with the use of the rotary cutting apparatus according to the present invention can be advantageously mixed into the synthetic resin or the concrete material uniformly thereby making it possible to manufacture the fiber reinforced synthetic resin moldings or the fiber reinforced concrete moldings.

In the practice of the foregoing method of manufacturing the fiber reinforced synthetic resin moldings or the fiber reinforced concrete moldings, while a fiber blow-off nozzle and a resin blow-off nozzle are juxtaposed to each other, staple fibers produced from the rotary cutting apparatus of the present invention by cutting organic filaments are continuously supplied onto the fiber blow-off nozzle while the synthetic resin is continuously supplied onto the resin blow-off nozzle, so that the resultant organic staple fibers and the synthetic resin can be simultaneously blow off from these fiber and resin blow-off nozzles onto a base surface thereby to form on the base surface a layer in which the organic staple fibers and the synthetic resin are uniformly mixed together. After the fiber-resin mixed layer on the base surface has been cured or hardened, the fiber reinforced synthetic resin molding can be obtained.

In the practice of the foregoing method, arrangement is made so that the cutting of the filaments to produce the staple fibers with the use of the rotary cutting apparatus of the present invention, the discharge of the synthetic resin from the fiber blow-off nozzle and the discharge of the resin blow-off nozzle can be effected in unison with each other. The amount of the staple fibers supplied to the fiber blow-off nozzle is determined depending on the speed at which the filaments are cut with the rotaralsoy cutting apparatus, i.e., the filament cutting speed. Although the rotary cutting apparatus and respective mechanisms for the fiber blow-off nozzle and the resin blow-off nozzle may be linked directly by using a common drive unit, it is preferred to employ a control mechanism including a detector means for detecting the amount of the synthetic resin discharged from the resin blow-off nozzle and a programmable means for selecting the amount of the staple fibers to be mixed with the synthetic resin so discharged in order to control respective operations of the rotary cutting apparatus and the respective mechanisms for the fiber blow-off nozzle and the resin blow-off nozzle.

The synthetic resin which may be used in the practice of the foregoing method may include any synthetic resin in a fluid form, for example, a solution or a viscous compound thereof, depending on the purpose for which the resultant fiber reinforced synthetic resin molding is used. By way of example, where a fiber reinforced synthetic resin molding desired to be formed is a bath tub, any vinyl ester resin or analsoy unsaturated polyester resin maalsoy be employed and, where the fiber reinforced concrete molding desired to be formed is a architectural external wall, any acrylic resin or any unsaturated polalsoyester resin may be employed. Where a fiber reinforced synthetic resin molding desired to be formed is a lining material, any vinyl ester resin or any epoxy resin may be employed.

In any event, the fiber-resin mixed layer formed on the base surface in the manner as hereinbefore described is heated to cure or harden thereby to complete the fiber reinforced synthetic resin molding either while the fiber-resin mixed layer lies on the base surface or after it has been removed from the base surface and subsequently reformed to any desired shape.

The manufacture of the fiber reinforced concrete moldings with the use of the rotary fiber cutting apparatus according to the present invention can be carried out in any one of the following three methods. One of these methods, i.e., a first method may be similar to the above described method of manufacturing the fiber reinforced synthetic resin moldings except that the synthetic resin is replaced with a concrete composition. It is to be noted that the concrete composition referred to hereinabove and hereinafter is intended to mean a mixture of cement and water with, if necessary sand particles or pulverized rocks.

Another one of the three contemplated methods is such that, while the rotary cutting apparatus of the present invention is set up at a site adjacent a concrete mixer, a required quantity of the staple fibers obtained by cutting the filaments with the use of the rotaralsoy cutting apparatus of the present invention can be continuously supplied into the concrete mixer and, at the same time, the concrete composition is continuously supplied into the concrete mixer so that within the concrete mixer the staple fibers can be mixed with the concrete composition to provide a fiber mixed concrete composition. The resultant fiber mixed concrete composition may be blown off onto a base surface through a blow-off nozzle thereby to form a fiber reinforced concrete layer or molding on the base surface.

The remaining contemplated method for the manufacture of the fiber reinforced concrete moldings with the use of the rotary fiber cutting apparatus according to the present invention is such that, while the rotary cutting apparatus of the present invention is installed at a site adjacent to a belt conveyor, a required quantitalsoy of the staple fibers obtained by cutting the filaments with the use of the rotary cutting apparatus of the present invention can be continuously supplied onto a concrete composition, which is then conveyed by means of the belt conveyor, to provide a mixture of the staple fibers with the concrete composition, which mixture is subsequently conveyed through the same belt conveyor towards the site where the mixture is deposited for placing onto a base surface desired to be covered with the fiber reinforced concrete moldings.

The mixing ratio of the staple fibers with the concrete composition can be chosen as desired or required, depending on physical properties which a resultant concrete structure is desired to have, and can be adjusted by adjusting the amount of the staple fibers or the concrete composition to be mixed with.

In the practice of the first-mentioned method for the manufacture of the fiber reinforced concrete moldings, the amount of the staple fibers obtained by the use of the rotary cutting apparatus of the present invention is, as is the case with that discussed in connection with the manufacture of the fiber reinforced synthetic resin moldings, preferred to be determined by the utilization of a control means including a detector means for detecting the amount of the concrete composition discharged from a concrete blow-off nozzle and a programmable means for selecting the amount of the staple fibers to be mixed with the concrete composition so discharged.

Also, in the practice of the second-mentioned method for the manufacture of the fiber reinforced concrete moldings, although the rotary cutting apparatus and the respective mechanisms for the fiber blow-off nozzle and the concrete blow-off nozzle may be linked directly by using a common drive unit, it is preferred to employ a control mechanism including a detector means for detecting the amount of the concrete composition discharged from the concrete mixer and a programmable means for selecting the amount of the staple fibers to be mixed with the concrete composition so discharged in order to control respective operations of the rotary cutting apparatus, the concrete mixer and a mechanism for the fiber blow-off nozzle.

Yet, in the practice of the third-mentioned method for the manufacture of the fiber reinforced concrete moldings, although the rotary cutting apparatus and a drive mechanism for the belt convealsoyor may be conveniently linked directly by using a common drive unit, it is preferred to employ a control mechanism including a detector means for detecting the amount of the concrete composition being transported through the belt conveyor and a programmable means for selecting the amount of the staple fibers to be mixed with the concrete composition so conveyed in order to control respective operations of the rotary cutting apparatus and the drive mechanism for the belt conveyor.

Hereinafter, specific examples of use of any one of the foregoing methods will be demonstrated for the purpose of showing the superiority of the rotary cutting apparatus constructed according to the present invention.

Case 1

The use was made of the rotary fiber cutting apparatus of a construction substantially shown in and described with reference to FIGS. 1 to 3 and is so designed as to cut the filaments to a predetermined length thereby to provide the staple fibers.

The rotary cutting apparatus of the type referred to above was combined with a juxtaposed arrangement of a fiber blow-off nozzle and a resin blow-off nozzle to provide a combination cutter and applicator apparatus. In this combination cutter and applicator apparatus, a control mechanism comprising a detector means for detecting the amount of resin discharged from the resin blow-off nozzle and a programmable means for selecting the amount of the staple fibers to be mixed with the synthetic resin was operatively associated therewith.

A viscous solution of vinyl ester resin having its viscosity adjusted to a proper value with the use of stylene monomer was loaded into a hopper and was then supplied from the hopper towards the resin blow-off nozzle having a discharge rate fixed at about 1.5 kg/min. On the other hand, bundles of 40 super high-tenacity multifilaments (240 deniers/36 filaments), each made of all aromatic polyester, were fed onto the rotary cutting apparatus at a feed rate of 900 meters per minute to provide staple fibers of 100 mm in length which were subsequently supplied to the fiber blow-off nozzle having its discharge rate fixed at about 0.96 kg/min. The mixing ratio by weight of the staple fibers relative to the synthetic resin was 1:0.64.

The staple fibers supplied to the fiber blow-off nozzle and the synthetic resin supplied to the resin blow-off nozzle was simultaneously and continuously sprayed onto a pre-treated wooden mold used to manufacture a bath tub for a length of time sufficient to form the coating, about 2.5 mm in thickness, of a mixture of the staple fibers and the synthetic resin on an inner surface of the pre-treated wooden mold. The wooden mold having the coating so deposited thereon was allowed to stand in a room for about 2 hours and was subsequently allowed to stand in a drying room, heated to 50° C., for 1.5 hour for curing the coating. Thereafter, the wooden mold was disassembled to release a fiber reinforced bath tub which was subsequently subjected to a surface finishing process, thereby completing the manufacture of the fiber reinforced resin bath tub.

The resultant fiber reinforced resin bath tub was found to be light-weight as compared with the conventional fiber reinforced resin bath tub in which the glass fibers are employed. Also, an inspection of a piece cut from the fiber reinforced resin bath so manufactured has shown that the staple fibers and the synthetic resin were uniformly mixed together.

Case 2

Using the combination cutter and applicator apparatus identical to that used in Case 1 above, a viscous solution of unsaturated polyester resin having its viscosity adjusted to a proper value with the use of stylene monomer was loaded into a hopper and was then supplied from the hopper towards the resin blow-off nozzle having a discharge rate fixed at about 1 kg/min. On the other hand, bundles of 5 super high-tenacity multifilaments (1,800 deniers/1,000 filaments), each made of polyvinyl alcohol, were fed onto the rotary cutting apparatus at a feed rate of 200 meters per minute to provide staple fibers of 30 mm in length which were subsequently supplied to the fiber blow-off nozzle having its discharge rate fixed at about 0.20 kg/min. The mixing ratio by weight of the staple fibers relative to the salsoynthetic resin was 1:0.5.

The staple fibers supplied to the fiber blow-off nozzle and the synthetic resin supplied to the resin blow-off nozzle was simultaneouslalsoy and continuouslalsoy sprayed onto an outer surface of a building external wall for a length of time sufficient to form the coating, about 1.5 mm in thickness, of a mixture of the staple fibers and the synthetic resin. After the coating on the outer surface of the building wall had been gelled to a state sufficient for it to be moldable, the coating was patterned to have indentations with the use of a patterning roll.

An inspection of the fiber reinforced resin coating on the building external wall has shown that the staple fibers and the synthetic resin were uniformly mixed with no fiber protruding outwardly therefrom. Also, when the building external wall having the fiber reinforced resin coating formed thereon was tested as to the weatherabilitalsoy and the aging, it has been found that neither shrinkage nor cracking occurred, exhibiting a high stability.

Case 3

The combination cutter and applicator apparatus identical to that used in Case 1 above was installed adjacent to a screw mixer. The screw mixer and a drive unit for the combination cutter and applicator apparatus were liked together through a control device so that the both can operate in association with each other.

A concrete composition prepared by the use of a cement mixer was continuously supplied into the screw mixer at a rate of about 30 liters per minute. On the other hand, bundles of 4 super high-tenacity monofilaments (1,500 deniers/1 filament), each made of polyvinyl alcohol, were fed onto the rotary cutting apparatus at a feed rate of 586 meters per minute to provide staple fibers of 30 mm in length which were subsequently supplied to the concrete mixer at a rate of about 390 grams per minute (1 percent by volume relative to the amount of the concrete composition).

The staple fibers and the concrete composition both supplied to the concrete mixer were stirred for 1 minute to mix them together thereby providing a fiber containing concrete composition and was then supplied to a mixture blow-off nozzle. While a concrete curing agent "NATOMIC" (manufactured and sold by Denki Kagaku Kogyo Kabushiki Kaisha of Japan) was injected into the mixture blow-off nozzle, the fiber containing concrete composition was subsequently continuously sprayed onto a surface of an excavated tunnel through the mixture blow-off nozzle to form a fiber reinforced concrete lining of about 2.5 mm in thickness. The spraying of the fiber containing concrete composition through the mixture blow-off nozzle took place satisfactorily.

Subsequent to the spraying of the fiber containing concrete composition to form the fiber reinforced concrete lining, the latter was allowed to stand for about 1 hour before it completely cured. An inspection of the fiber reinforced concrete lining after the curing has shown that no fiber ball was found in the fiber reinforced concrete lining and the staple fibers were satisfactorily and uniformly dispersed in the concrete composition. This method of forming the fiber reinforced concrete lining is high in stability and effective to reduce the period of work and could, consequently, contribute to a reduction in costs such as personnel expenses.

Case 4

A system of a fiber blow-off nozzle and a concrete blow-off nozzle juxtaposed with each other was combined with the rotary cutting apparatus of a type similar to that used in Case 1 above to provide a combination cutter and applicator apparatus. This combination cutter and applicator apparatus was then linked with a control device, comprising a detector means for detecting the amount of the concrete composition discharged from the concrete blow-off nozzle and a programmable means for selecting the amount of the staple fibers to be mixed with the concrete composition, so that the both can operate in association with each other.

The concrete composition after having been conditioned was loaded into a cement mixer and was, after having been stirred and mixed in the concrete mixer, and while a concrete curing agent ("NATOMIC" manufactured and sold by Denki Kagaku Kogyo Kabushiki Kaisha of Japan) was injected into the concrete blow-off nozzle, continuously supplied to the concrete blow-off nozzle having its discharge rate fixed at 42 liters per minute. On the other hand, bundles of 5 super high-tenacity multifilaments (1,800 deniers/1,000 filaments), each made of polyvinyl alcohol, were fed onto the rotary cutting apparatus at a feed rate of 600 meters per minute to provide staple fibers of 50 mm in length which were subsequently supplied to the concrete blow-off nozzle at a rate of about 600 grams per minute (1.1 percent by volume relative to the amount of the concrete composition).

The staple fibers and the concrete composition were thereafter sprayed continuously and simultaneously onto a base surface desired to be cemented, to form a fiber reinforced concrete covering having a thickness of 6 cm. above the base surface. The spraying of analsoy one of the staple fibers and the concrete composition from the associated nozzle took placesatisfactorily.

Subsequent to the spraying of both of the staple fibers and the concrete composition, the resultant fiber reinforced concrete covering was allowed to stand for about 0.5 hour to dry. An inspection of a piece of the fiber reinforced concrete covering which was removed by grinding the fiber reinforced concrete covering to a depth of 2 cm. beneath the outermost surface has shown that no fiber ball was found in the fiber reinforced concrete covering and the staple fibers were satisfactorily and uniformly dispersed in the concrete composition. This method of forming the fiber reinforced concrete covering on the base surface is high in stability and effective to reduce the period of work and could, consequently, contribute to a reduction in costs such as personnel expenses.

Case 5

The rotary cutting apparatus of the type identical with that used in Case 1 above were placed above a belt conveyor. Using this rotary cutting apparatus, bundles of 100 super high-tenacity filaments of polypropylene yarn (250 deniers/filament) supplied at a feed rate of about 1.95 kg per minute (1.2 percent by volume relative to the concrete composition) were cut to provide staple fibers of 100 mm in length, which were subsequently supplied continuously onto the concrete composition then conveyed through the belt conveyor at a rate of about 0.18 $m^3$ per minute. Thereafter, a mixture of the staple fibers with the concrete composition was transported using the same belt conveyor to a site where it was desired to be placed and was then deposited on a base surface to form the fiber reinforced concrete deposit on the base surface.

After the fiber reinforced concrete deposit had been allowed to stand for about 5 hours, an inspection of the resultant fiber reinforced concrete deposit has shown that no fiber ball was found in the fiber reinforced concrete deposit and the staple fibers were satisfactorily and uniformly dispersed in the concrete composition. This method of forming the fiber reinforced concrete deposit on the base surface was found to be effective to reduce the period of work to two thirds of that required in the practice of the conventional comparable method and, therefore, effective to reduce a variable cost and, hence, the total construction cost required to accomplish a construction.

Comparison 1

Using a large-sized fiber cutting machine installed in a plant, bundles of 100 polypropylene yarns (250 deniers/filament) were cut to provide staple fibers of 100 mm in length. The resultant staple fibers were charged in installments of about 27 kg into a cement mixer loaded with about 4 $m^3$ of concrete composition and were then stirred for about 10 minutes to mix with the concrete composition. The resultant mixture of the staple fibers with the concrete composition was subsequently transported to a site where it was desired to be placed, and was then placed there.

After the mixture of the staple fibers and the concrete composition so placed at the site had been allowed to stand for about 5 hours, an inspection of the resultant fiber reinforced concrete covering has revealed that numerous fiber balls were found, showing that the staple fibers were not uniformly dispersed in the concrete composition. It has also been found that the fiber reinforced concrete covering after having been cured was susceptible to cracks.

Thus, according to the present invention, the super high-tenacity fibers having a high tensile strength and a high Young's modulus can be continuously cut at a high constant speed in a stabilized fashion to the predetermined length to provide the staple super high-tenacitalsoy fibers which may be in turn used as a reinforcement material or in any wide range of application. In the practice of the present invention, since the impact shearing force is utilized to cut the super high-tenacity fibers, the possibility of the cutting blades being damaged, worn out or bent can advantageously be reduced, making it possible to run the rotary cutting apparatus for a prolonged period of time. Also, since the rotary cutting apparatus of the present invention is of a simplified mechanism, the apparatus compact in size and easy to handle can be serviced. Again, since the continuous and stabilized cutting of the super high-tenacity fibers is possible with the rotary cutting apparatus of the present invention, the rotary cutting apparatus itself may be used as a fiber supplalsoy equipment from which the staple fibers can be supplied onto the next subsequent processing station or machine.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, although the rotary disc assembly D has been described as driven by the effect of a frictional force transmitted from the V-sectioned endless belt 11 which is motor-driven, the rotary disc assembly D may be motor-driven so that the V-sectioned endless belt 11 can be driven by the effect of a frictional force transmitted from the rotaralsoy disc assembly D.

Also, if a plurality of the rotary cutting apparatuses of the present invention are arranged in side-by-side relation to each other in a direction parallel to the axis of rotation of each of the rotary disc assemblies, and if a belt convealsoyor is disposed beneath the juxtaposed rotary cutting apparatuses, the staple fibers cut at a constant speed from the juxtaposed rotary cutting apparatuses may fall onto the belt conveyor to continuously form a laminated fiber mat of a predetermined thickness, making it possible to facilitate the manufacture of strand mats.

Accordingly, such changes and modifications are, unless thealsoy depart from the spirit and scope of the present invention as delivered from the claims annexed hereto, to be construed as included therein.

What is claimed is:

1. A method of continuously cutting fibers to a predetermined length to provide staple fibers with the use of a rotaralsoy cutting apparatus comprising at least one rotatably supported disc having a peripheral surface formed with a circumferential row of engagement projections radially outwardly protruding therefrom and spaced at intervals of a predetermined pitch and at least one cutting blade, said disc being rotatable sequentially past a deliveralsoy station and then past a cutting station during one complete rotation thereof, said cutting blade being disposed so as to cooperate with every other one of said engagement projections on the disc to cut the fibers, which method comprises the steps of:

delivering at the delivery station the fibers onto the disc, while the disc is driven in one direction, so as to cause the fibers to be substantially traversed in a zig-zag fashion while extending alternately outwardly and inwardly around the engagement projections;

during a continued feed of the fibers with the disc driven in said one direction, causing portions of the fibers, which extend inwardly around every other one of said engagement projections, to be pressed against such every other one of said engagement projections by pressing means;

transporting portions of the fibers, which extend outwardly around every other one of said engagement projections, towards the cutting station; and causing said portions of the fibers extending outwardly around every other one of said engagement projections to be cut by an impact shearing action created by the cutting blade in cooperation with said every other one of said engagement projections around which said portions of the fibers extend outwardly, thereby providing the staple fibers.

2. A rotary cutting apparatus for continuously cutting fibers to a predetermined length to provide staple fibers, which apparatus comprises:

a rotary disc assembly having at least one circumferential row of engagement projections formed on an outer peripheral surface thereof so as to protrude radially outwardlalsoy therefrom and circumferentially spaced at intervals of a predetermined pitch in a direction conforming to a direction of rotation of the rotary disc assembly;

a turning means for delivering the fibers onto the rotary disc assembly at a delivery station, while the disc assembly is driven in one direction, so as to cause the fibers to be substantially traversed in a zig-zag fashion while extending alternatelalsoy outwardly and inwardly around the engagement projections;

a pressing means for successively urging portions of the fibers, which have been turned around the rotary disc assembly so as to extend inwardly around every other one of said engagement projections, to engage such every other one of said engagement projections during a continued rotation of the rotary disc assembly;

a cutting blade disposed at a cutting station defined at a location spaced angularly from the delivery station in a direction conforming to the direction of rotation of the rotary disc assembly, said cutting blade being cooperable with every other one of said engagement projections on the disc to cut successively portions of the fibers which have been turned around the rotary disc assembly so as to extend outwardly around every other one of said engagement projections, therebalsoy to provide the staple fibers.

3. The rotary cutting apparatus as claimed in claim 2, wherein each of the engagement projections has inner and outer side faces facing in a direction parallel to an axis of rotation of the rotary disc assembly; and wherein said pressing means urges the portions of the fibers successively against said every other one of said engagement projections around which the portions of the fibers extend inwardly so as to contact the inner side faces thereof; and wherein said cutting blade is cooperable with the outer side faces of every other one of said engagement projections to cut successively the portions of the fibers which have been turned around the rotary disc assembly so as to extend outwardly around every other one of said engagement projections.

4. The rotary cutting apparatus as claimed in claim 3, wherein each of the respective outer side faces of every other one of said engagement projections is in flush with outer side surfaces of the rotary disc assembly while each of the respective inner side faces of the remaining engagement projections is in flush with inner side surfaces of the rotary disc assembly.

5. The rotary cutting apparatus as claimed in claim 2, wherein said pressing means comprises an endless belt trained around the rotary disc assembly and driven in unison with the rotation of the rotary disc assembly.

6. The rotary cutting apparatus as claimed in claim 2, wherein said turning means comprises a traversing device adapted to be driven in synchronism with the rotation of the rotary disc assembly for delivering the fibers onto the rotary disc assembly while causing the fibers to be substantially traversed in a direction parallel to the axis of rotation of the rotary disc assembly at a cycle corresponding to the predetermined pitch between each neighboring engagement projection thereby to lay the fibers in a zig-zag fashion on the rotaralsoy disc assembly while extending alternately outwardly and inwardly around the engagement projections.

7. The rotary cutting apparatus as claimed in claim 2. wherein said rotary disc assemblalsoy comprises a pair of rotary discs and an intermediate coupling barrel connecting the rotary discs coaxially together;

wherein said circumferential row of the engagement projections is formed on an outer peripheral surface of each of the rotary discs; and wherein said cutting blade is disposed on respective sides of the rotary discs remote from the intermediate coupling barrel so as to cooperate with every other one of said engagement projections in the corresponding circumferential row.

8. The rotary cutting apparatus as claimed in claim 7, wherein said pressing means comprises an endless belt trained around the rotary disc assembly and driven in unison with the rotation of the rotary disc assembly, said endless belt having a generally V-shaped cross-section and also having a pair of side faces extending so as to diverge in a direction radially outwardly of the rotary disc assembly, said side faces of the endless belt being cooperable with inner side faces of every other one of said engagement projections to clamp the fibers therebetween, each of said inner side faces being inclined to follow an inclination of the adjacent side face of the endless belt; and wherein a portion of the endless belt trained around the rotary disc assembly is operatively received within an annular space delimited between the rows of the engagement projections.

* * * * *